United States Patent [19]

Gosset et al.

[11] Patent Number: 5,045,130

[45] Date of Patent: Sep. 3, 1991

[54] SOLUTION AND PROCESS FOR COMBINED PHOSPHATIZATION

[75] Inventors: M. Serge Gosset, Lestrem; M. Jean-Claude Malras, Erquinghem-sur-la-Lys, both of France

[73] Assignee: Compagnie Francaise de Produits Industriels, Gennevilliers, France

[21] Appl. No.: 211,448

[22] Filed: Jun. 23, 1988

[30] Foreign Application Priority Data

Jun. 25, 1987 [FR] France ..... 87 08989

[51] Int. Cl.[5] ..... C23C 22/23

[52] U.S. Cl. ..... 148/257; 148/262

[58] Field of Search ..... 148/257, 262

[56] References Cited

U.S. PATENT DOCUMENTS

| | | | |
|---|---|---|---|
| 2,826,517 | 3/1958 | Miller et al. . | |
| 2,955,967 | 10/1960 | Blaser et al. . | |
| 3,338,755 | 8/1967 | Jenkins | 148/262 |
| 3,869,317 | 3/1975 | Marx | 148/6.15 Z |
| 4,231,812 | 11/1980 | Paulus | 148/6.15 Z |
| 4,474,626 | 10/1984 | Lumaret | 148/6.15 Z |

FOREIGN PATENT DOCUMENTS

| | | |
|---|---|---|
| 0042631 | 12/1981 | European Pat. Off. . |
| 0102284 | 3/1984 | European Pat. Off. . |
| 0175606 | 3/1986 | European Pat. Off. . |
| 973195 | 12/1959 | Fed. Rep. of Germany . |
| 2247165 | 9/1972 | Fed. Rep. of Germany . |
| 2931693 | 12/1980 | Fed. Rep. of Germany . |
| 2492413 | 4/1982 | France . |

*Primary Examiner*—Sam Silverberg

*Attorney, Agent, or Firm*—Larson and Taylor

[57] ABSTRACT

Combined phosphatization acid solution suitable for producing on a metallic substrate a concomitent deposit of at least two metallic ions, of which at least one is generally selected from the group comprising zinc, manganese and iron, said solution being characterized by the fact that it contains a polyphosphate having the formula $(XPO_3)_n$ wherein $n \geqq 3$ and X represents an alkaline, alkaline-earth metal or ammonium, and a chelating agent.

14 Claims, No Drawings

SOLUTION AND PROCESS FOR COMBINED PHOSPHATIZATION

The invention relates to an aqueous acid solution for the mixed or combined phosphatization, this expression designating any phosphatization process capable of producing on a metal substrate a concomitent deposit of at least two metal ions, of which at least one is generally selected from the group comprising zinc, manganese and iron.

It also relates to a process of phosphatization using said solution.

The metal substrates capable of being treated by using the aforesaid solution and process are most especially those based on iron and alloys of this metal.

Let it be reminded that the traditional treatments of phosphatization serve the purpose, depending on the case involved.

of enhancing the adhesive capacity of organic coatings on the treated substrates, most especially paints and varnishes or lacquers, applied at a later stage.

of increasing the resistance of the substrates against corrosion.

in the most particular case of metal parts intended for cold working operations, of creating on the metal surface an "anti-friction" layer which makes it possible to improve the characteristics of the metal surface after cold working operations, furthermore of avoiding the direct contact with the tool and therefore of reducing the frictions and of increasing the life duration of the tool and finally, in connection with the lubrication of mechanical moving parts, particularly during the run-in phase, of avoiding the metal-metal contact and consequently seizing or freezing phenomena.

When one most particularly aims at obtaining an "anti-friction" layer, one generally resorts to the so-called combined phosphatization processes, especially those of the zinc-manganese type, the goal of these processes being then particularly to increase the amount of manganese in the resulting deposits.

In this respect, the European patent application N. 81200442.2 can be mentioned.

Nonetheless, the anti-friction features of the deposits obtained by using this process, although proving to be of a higher quality than the deposits obtained by prior processes, remain insufficient in view of the increasingly more exacting requirements imposed by the users (steel processing industry) upon the manufacturers of phosphatization techniques, said users furthermore requiring an improvement of the anti-corrosion properties of the treated substrates as well as an improvement of the adhesive capacity of paints or other film-forming coatings on these substrates.

The merit of the Applicant Company is to have succeeded in decisively improving the above-mentioned properties as regards the resulting deposits and especially in decisively increasing the amount of manganese, whenever it is available, in the coatings obtained by the mixed or combined phosphatization process, by providing the combined phosphatization solutions involved with efficient quantities on the one hand, of a water-soluble polyphosphate having the formula $(XPO_3)_n$ wherein $n \geqq 3$ and X represents an alkaline, alkaline-earth metal or ammonium and on the other hand, an organic chelating agent.

More particularly, in the case of a combined zinc-manganese phosphatization, the acid solution of combined phosphatization according to the invention is characterized by the fact that it includes at least approximately 0.5 g/l of zinc ion.

at least approximately 2 g/l of manganese ion.

at least approximately 2 g/l of polyphosphate of the formula $(XPO_3)_n$ wherein $n \geqq 3$ and X represents an alkaline, alkaline-earth metal or ammonium and at least approximately 0.5 g/l of a chelating agent.

In the event that adhesion of paints is particularly contemplated, nickel ion will be introduced in the mixed acid phosphatization solution, complementary to manganese or in replacement of manganese.

Consequently, the above-said mixed acid phosphatization solution according to the invention is also characterized by the fact that it comprises either at least 0.5 g/l of zinc ion and at least 0.5 g/l of nickel ion, or at least 0.5 g/l of zinc ion, at least 0.5 g/l of manganese ion at least 0.5 g/l of nickel ions, the nature of the proportions of the other constituents being inchanged.

The invention also relates to several other measures implemented separately or in combination and which will now be described.

Thus, the upper limits of quantities for polyphosphate, organic chelating agent, Zn ions, Mn ions and Ni ions brought under the form of salts, as the case may be those of the chelating agent, contained in the composition of this solution according to the invention are only imposed, theoretically, by the limits of solubility: in practice, one shall endeavor to choose a quantity of polyphosphate compatible with a good yield of the process covered by the invention, whereby avoiding that the sludges thus built up do not prove too substantial.

Concerning the proportions of zinc, manganese and nickel ions in the constitution of the above-said mixed acid phosphatization solution, they are a) as far as zinc and manganese ions are concerned, $0.5\ g/l \leqq Zn\ ion \leqq 10\ g/l$ $2\ g/l \leqq Mn\ ion \leqq 6\ g/l$ and preferably $0.5\ g/l \leqq Zn\ ion \leqq 6\ g/l$ $2\ g/l \leqq Mn\ ion \leqq 4\ g/l$, b) as far as zinc and nickel ions are concerned, $0.5\ g/l \leqq Zn\ ion \leqq 10\ g/l$ $0.5\ g/l \leqq Ni\ ion \leqq 6\ g/l$ and preferably $0.5\ g/l \leqq Zn\ ion \leqq 10\ g/l$ $0.5\ g/l \leqq Ni\ ion \leqq 3\ g/l$, c) as far as zinc, manganese and nickel ions are concerned, when they are used together, $0.5\ g/l \leqq Zn\ ion \leqq 10\ g/l$ $0.5\ g/l \leqq Mn\ ion \leqq 5\ g/l$ $0.5\ g/l \leqq Ni\ ion \leqq 6\ g/l$ and preferably $0.5\ g/l \leqq Zn\ ion \leqq 6\ g/l$ $2\ g/l \leqq Mn\ ion \leqq 4\ g/l$ $0.5\ g/l \leqq Ni\ ion \leqq 3\ g/l$.

According to an advantageous embodiment of the solution according to the invention, the polyphosphate is selected from the group constituted by sodium trimeta-, tetramta and hexametaphosphate, sodium hexametaphosphate or HMPP being preferred.

According to another advantageous embodiment of the solution according to the invention, the chelating agent is selected from the group consisting of:

ethylene-diamine-tetracetic acid or EDTA, nitrilotriacetic acid or NTA, diethylene-triamine-pentacetic acid or DTPA.

polycarboxylic acids, especially citric. oxalic, malic, glutamic, tartric, asparic and malonic acids, as well as the salts thereof.

polyhydroxycarboxylic acids, especially gluconic and glucoheptonic acids (as the case may be brought under the form of internal lactone) as well as the salts thereof.

According to another advantageous embodiment, the solution according to the invention comprises a mineral acid selected from the group consisting of sulfuric, hydrochloric and nitric acids, nitric acid being preferred in an amount sufficient to bring the pH to an initial value lower than 2, preferably comprised between 0.5 and 1.7.

Nitric acid is preferred because of its oxidizing character.

According to another advantageous embodiment of the aforesaid solution, it comprises sodium hexametaphosphate gluconic acid under the form of one of its salts or of its internal lactone.

zinc ion, manganese ion, nitric acid.

According to another advantageous embodiment of the solution according to the invention, the zinc ion and the manganese ion are introduced under the form of salts, especially selected from the group consisting of oxides, sulfates, nitrates, carbonates and phosphates.

According to another advantageous embodiment of the solution according to the invention, zinc ion and/or manganese ion are introduced under the combined form with the chelating agent, preferably under the form of citrate, tartrate, glucoheptonate and most particularly under the form of gluconate.

According to another advantageous embodiment, the solution according to the invention comprises sodium hexametaphosphate, zinc gluconate, manganese ion brought under the form of salt or under the form of gluconate, and nitric acid.

According to another advantageous embodiment, the phosphatization solution according to the invention comprises from 8 g/l to 350 g/l, preferably from 14 to 300 g/l and, more preferentially still, from 30 to 230 g/l of a composition consisting of polyphosphate, the chelating agent and zinc and manganese ions under the form of their salts which may be those of the chelating agent.

According to another advantageous embodiment of the solution according to the invention.

the weight ratio between, on the one hand, a mixture constituted by zinc and by manganese (both of them expressed in terms of metallic ion) and, on the other hand, sodium hexametaphosphate, is comprised between approximately 6/1 and 1/50, preferably between approximately 3/1 and 1/20 and, more preferentially still, between approximately 1.5/1 and 1/5.

the weight ratio between zinc and manganese is comprised between 0.01/1 and 50/1, preferably between 0.2/1 and 20/1 and, more preferentially still between 0.5/1 and 5/1, and the weight ratio between gluconic ion and sodium hexametaphosphate is comprised between 50/1 and 1/30, preferably between approximately 30/1 and 1/10 and, more preferentially still, between approximately 10/1 and 1/4.

According to another advantageous embodiment of the solution according to the invention, the mixture constituted by zinc ion and manganese ion is used in a quantity comprised between 2.5 and 0.30 g/l and the quantity of hexametaphosphate used is from 2 to 30 g/l.

The combined phosphatization process with zinc according to the invention and which successively comprises:

a degreasing step, a rinsing step, an acid step of reactivation, an optional rinsing step, especially if the reactivating bath is constituted by a nitric acid solution, the phosphatization step proper, a rinsing step, then an optional drying step depending on future treatments possibly involved in a subsequent phase, is characterized by the fact that, for the phosphatization step proper, one uses the combined phosphatization solution with zinc according to the invention which is applied by means of a dipping or spraying method (the step of reactivation and the facultative further rinsing step can be substituted by refining step comprising for instance Jernstedt salts on the basis of titane), being understood that on the one hand, the temperature of the solution is comprised between approximately 40° C. and 100° C., more particularly higher than 70° C. and, in the practice, close to 90°-98° C., on the other hand, that the contact between the phosphatization solution and the metal substrate is maintained for a duration varying, in the practice, from 2 seconds to 30 minutes, preferably from 5 to 20 minutes.

By comparing this process with the succession of steps involved in the processes according to the prior art, the resulting simplification is plainly seen, especially by eliminating the passivation and "greasing" steps whenever a corrosion protection is desired.

Actually, the items or objects treated by using the process according to the invention can be stored in the open air without any previous protective treatment and this, without resulting in the occurrence of deterioration phenomena on the layer.

According to a preferred embodiment, the pH of the phosphatization solution is made to increase from the initial value comprised between 0.5 and 1.7 up to a value comprised between 2.3 and 2.9 by adding to the solution a sufficient quantity of iron filings, comprised between 0.3 and 5 g/l of a solution and most preferentially between 1 and 4 g/l.

After having allowed the phosphatization solution to stand and ripen, it is ready for use.

The iron serves as catalyst (or as reducing agent) for the conversion. In fact, the lack of iron or the presence of too small a quantity of iron, lower than 0.3 g/l, it can be observed that no deposit of phosphate is being formed on the metal substrate. It is only when the concentration of the latter in iron has reached the necessary minimum value, because of the attack of the substrate by the solution, that the conversion phenomenon can take place.

Beside the aforesaid components, the solution according to the invention may advantageously comprise:

wetting agents, agents enhancing the conversion on the surface of hollow parts such as certain car body parts, whereby these agents may be compounds of titanium such as $TiCl_4$, conversion accelerators or promoters such as nickel, copper, and others, brought under the form of nitrate, nitrite, fluoride, chlorate, molybdate or the acids thereof.

The nickel content in the bath can be comprised between 0.5 and 6 g/l and preferably between 0.5 and 3 g/l.

In such a way, in the phosphotization solution according to the invention, nitric acid is particularly preferred as accelerating or promoting agent, and makes it possible to considerably improve the rate at which the deposit builds up.

The preferred concentration in nitric acid is comprised between 0.4 g/l and 60 g/l, more preferentially between 2 and 50 g/l and, more preferentially still, between 5 and 30 g/l.

The solution according to the invention results in layers of conversion featuring particularly interesting characteristics. Thus, the analysis of the deposits taken from the surface of the treated objects has shown that, surprisingly, the composition of these deposits was characterized by a manganese content substantially higher than the one obtained with solutions of phosphatization used in the prior art; incidentally, this content may exceed 10%.

Due to the increase in the manganese content of the deposits, their properties are improved, particularly as regards applications relating to the treatment of metal parts intended for being subjected to frictions or to cold working processes.

These deposits, owing to their absorbing properties, are capable of retaining the lubricating agents more efficiently on the surface of the part.

Furthermore, during the run-in phases, the condition of surface makes it possible to reduce the frictional forces, to increase the forming or shaping rates and to decrease the amount of wear of the material.

The thickness of the obtained layers is sufficient for the mechanical stresses to be taken up.

Eventually, because of the acidity of the solution, the crystals which constitute the deposits are perfectly anchored on the metal surface, which confers a remarkable mechanical resistance on said deposits.

Beside the mechanical qualities as reminded above, and owing to both their structure and their content in manganese, the deposits obtained through the solution in accordance with the invention possess a remarkable resistance to corrosion and constitute an outstanding bonding basis for most organic coatings.

Besides, further major advantages obtained thanks to the invention lie on the one hand in the decisive reduction of quantities of phosphate sludges built up during the phosphatization treatments and, in the fact, that the solution according to the invention is essentially comprised of biodegradable products.

The invention may still be better understood with the help of the following examples which relate to advantageous embodiments.

EXAMPLE 1

Steel metal samples with dimensions of 9.5×6.5 cm having been subjected to a chemical degreasing process, followed by a chemical cold pickling in 6N hydrochloric medium are dipped into a solution of phosphatization according to the prior art comprising:

16.9 g/l of 85% phosphoric acid, 19.7 g/l of $ZnSO_4$, $H_2O$, i.e. an equivalent in Zn of 7.2 g/l, 22.8 g/l of $MnSO_4$, $H_2O$, i.e. an equivalent in Mn of 7.4 g/l, 0.65 g/l of iron brought under the form of iron filings, 4.2 g/l of $NO_3^-$ ion.

During the treatment whose duration is 15 minutes, the bath temperature is maintained at 97° C. Following the treatment, the plates are rinsed with demineralized water and dried.

The crystalline deposit thus built up is collected by scraping.

It shows the following characteristics:

thickness: 20 μm, content in zinc: 26.2%, content in manganese: 4.41%.

EXAMPLE 2

Steel metal samples similar to the ones used in example 1 are subjected to a chemical degreasing process, followed by chemical pickling in 6N hydrochloric medium, then dipped into a solution of phosphatization comprising:

15 g/l of sodium hexametaphosphate 19.7 g/l of $ZnSO_4$, $H_2O$, i.e. an equivalent in Zn of 7.2 g/l, 22.8 g/l of $MnSO_4$, $H_2O$, i.e. an equivalent in Mn of 7.4 g/l, 1 g/l of iron brought under the form of iron filings, 5.6 g/l of $NO_3$-ion, As in example 1, the treatment duration is 15 minutes, whereby the solution temperature is adjusted to 97° C.

The deposit obtained from this conversion solution shows the following characteristics:

thickness: 5 to 10 μm, content in zinc: 30.7%, content in manganese: 5.83%.

This example shows that the replacement of phosphoric acid with sodium hexametaphosphate brings about a deposit which is richer in manganese than the one obtained by the solution described in example 1.

However, this deposit features the drawback of a smaller, unsmooth thickness, showing gaps in certain areas of the treated plate; the unsmoothness of the deposit is not compatible with a proper protection against corrosion and an efficient lubrication of the metallic part, if the latter is to be subjected to a cold working operation.

The use of a polyphosphate alone is therefore not sufficient.

EXAMPLE 3

In this test, the samples and the experimental method used are identical with the ones described in examples 1 and 2. The solution implemented is however different; it comprises:

16.9 g/l of 85% phosphoric acid, 60 g/l of zinc gluconate, i.e. an equivalent in zinc of 7.2 g/l, 60 g/l of manganese gluconate, i.e. an equivalent in Mn of 7.4 g/l,
1 g/l of iron brought under form of iron filings,
17.5 g/l of $NO_3^-$ ion.

The deposit obtained by means of this solution as described above shows the following characteristics:
thickness: 8 to 20 μm,
content in zinc: 26.3%,
content in manganese: 6.00%.

It is found that the addition of zinc and manganese under the form of gluconate makes it possible to substantially increase the content in manganese in the deposit. Gluconic ion, by its action on the chemical reaction equilibria, promotes the settling of manganese phosphate at the level of the steel plate and influences the crystal size: the crystalline deposit is thinner and more homogeneous than the one obtained with the conversion solution of example 1.

In return, the thickness of the coating is very unsmooth and the whole of the treated plates evidence phosphatization defects.

The use of the chelating agent alone is there again not sufficient.

EXAMPLE 4

In this test, the samples and the experimental method used are identical with the ones described in the foregoing examples. The phosphatization solution implemented comprises:
15 g/l of sodium hexametaphosphate,
60 g/l of zinc gluconate, i.e. an equivalent in zinc of 7.2 g/l,
60 g/l of $MnSO_4$, $H_2O$, i.e. an equivalent in Mn of 7.4 g/l,
2 g/l of iron brought under the form of iron-filings,
17.5 g/l of $NO_3^-$ ion.

The deposit obtained with this solution shows the following characteristics:
thickness: 20 μm,
content in zinc: 30.7%,
content in manganese: 6.75%.

This solution results in a manganese-rich deposit, particularly suitable for use as coating prior to cold working. Moreover, this thin, dense and smooth crystalline deposit makes it possible to ensure an appropriate protection against corrosion.

Consequently, a polyphosphate and a chelating agent used jointly, as provided by the invention, not only lead to a substantial increase in the content in manganese of the deposit, but additionally enable a good quality deposit to be obtained.

EXAMPLE 5

In this test, the samples and the method used are identical with the ones described in the foregoing examples. The phosphatization solution implemented comprises:
15 g/l of sodium hexametaphosphate,
60 g/l of zinc gluconate, i.e. an equivalent in zinc of 7.2 g/l,
60 g/l of manganese gluconate, i.e. an equivalent in Mn of 7.4 g/l,
1 g/l of iron brought under the form of iron filings,
21 g/l of $NO_3^-$ ion.

The deposit obtained by means of this solution shows the following characteristics:
thickness: 20 to 25 μm,
content in zinc: 28.6%,
content in manganese: 6.97%.

This solution leads to a deposit whose content in manganese is particularly high; this deposit is perfectly suitable for cold working operations and besides, shows a thin, smooth, crystalline appearance, therefore offering a proper protection against corrosion.

This example shows that very good results can be obtained when the chelating agent is introduced under the form of its salts of Zn and of Mn.

EXAMPLE 6

In this example, the metallic samples and the experimental method used are identical with the ones described in the foregoing examples. The phosphatization solution implemented comprises:
15 g/l of sodium hexametaphosphate,
19.7 g/l of $ZnSO_4$, $H_2O$, i.e. an equivalent in zinc of 7.2 g/l,
22.8 g/l of $MnSO_4$, $H_2O$, i.e. an equivalent in Mn of 7.4 g/l,
1 g/l of iron brought under the form of iron filings,
17.5 g/l of $NO_3^-$ ion,
114 g/l of sodium gluconate.

In this solution, the addition of gluconic ion takes place under the form of sodium gluconate in order that the quantity of gluconic ion which is available be identical with the one encountered in solutions in which zinc and manganese are brought under the form of gluconate.

The deposit obtained by means of this solution shows the following characteristics:
thickness: 12 μm,
content in zinc: 27.3%,
content in manganese: 10.0%.

This solution results in the building of a deposit which is exceptionally rich in manganese. It proves to be of a steady and smooth function and makes it possible to obtain a thin, dense crystalline deposit of proper thickness ensuring an appropriate protection against corrosion.

This example shows that very good results can be obtained when, in the solution according to the invention, the chelating agent is introduced separately, that is to say not under the form of its salt of Zn and/or of Mn.

We claim:

1. A method of combined acid phosphatization of a metallic substrate with zinc and with at least another metal selected from the group consisting of manganese and nickel comprising subjecting the said metallic substrate to a phosphatization step by way of an acid phosphatization solution comprising
at least about 2 g/l of a polyphosphate having the formula $(XPO_3)_n$ wherein $n \geqq 3$ and X represents an alkaline, alkaline earth-metal or ammonium;
at least about 0.5 g/l of a chelating agent; and
one of the following combinations of metal ions of the group consisting of zinc, manganese and nickel:

| | | |
|---|---|---|
| (a) | 0.5 g/l ≦ zinc ion<br>2 g/l ≦ manganese ion | ≦ 10 g/l together with<br>≦ 6 g/l |
| (b) | 0.5 g/l ≦ zinc ion<br>0.5 g/l ≦ nickel ion | ≦ 10 g/l together with<br>≦ 6 g/l. |

2. A method according to claim 1, wherein the acid phosphatization solution comprises the following combination of metal ions:

| |
|---|
| 0.5 g/l ≦ zinc ion ≦ 10 g/l together with<br>2 g/l ≦ manganese ion ≦ 6 g/l. |

3. A method according to claim 1, wherein the acid phosphatization solution comprises the following combination of metal ions:

| |
|---|
| 0.5 g/l ≦ zinc ion ≦ 10 g/l together with<br>0.5 g/l ≦ nickel ion ≦ 6 g/l. |

4. A method according to claim 1, wherein the acid phosphatization solution comprises the following combination of metal ions:

| |
|---|
| 0.5 g/l ≦ zinc ion ≦ 6 g/l together with<br>2 g/l ≦ manganese ion ≦ 4 g/l. |

5. A method according to claim 1, wherein the acid phosphatization solution comprises the following combination of metal ions:

| |
|---|
| 0.5 g/l ≦ zinc ion ≦ 6 g/l together with<br>0.5 g/l ≦ nickel ion ≦ 3 g/l. |

6. A method according to claim 1, wherein the acid phosphatization solution comprises the following combination of metal ions:

| |
|---|
| 0.5 g/l ≦ zinc ion ≦ 6 g/l together with<br>2 g/l ≦ manganese ion ≦ 4 g/l and with<br>0.5 g/l ≦ nickel ion ≦ 3 g/l. |

7. A method according to claim 1, wherein the phosphatizing solution comprises a polyphosphate selected from the group consisting of sodium trimeta-, tetrameta- and hexameta-phosphate.

8. A method according to claim 1, wherein the phosphatizing solution comprises hexametaphosphate as polyphosphate.

9. A method according to claim 1, wherein the phosphatizing solution comprises a chelating agent selected from the group consisting of:

ethylene-diamine-tetracetic acid or EDTA, nitrilotriacetic acid or NTA, diethylene-triamine-pentacetic acid or DTPA, polycarboxylic acids, especially citric, oxalic, malic, glutamic, tartric, aspartic and malonic acids, as well as the salts thereof, polyhydroxycarboxylic acids, especially gluconic and glucoheptonic acids as well as the salts thereof.

10. A method according to claim 1, wherein the phosphatizing solution comprises a mineral acid selected from the group consisting of sulfuric, hydrochloric and nitric acids, in an amount sufficient to bring the pH to an initial value lower than 2.

11. A method according to claim 1, wherein the phosphatizing solution comprises at least 2 g/l of sodium hexametaphosphate, at least 0.5 g/l of gluconic acid under the form of one of its salts or of its internal lactone, at least 0.5 g/l of zinc ion, at least 2 g/l of manganese ion, nitric acid in an amount sufficient to bring the pH to an initial value lower than 2.

12. A method according to claim 1, wherein zinc ion and manganese ion are introduced into the phosphatization solution under the form of salts selected from the group consisting of oxides, sulfates, nitrates, carbonates and phosphates.

13. A method according to claim 1, wherein zinc ion and manganese ion are introduced into the phosphatization solution under the combined form with the chelating agent selected from the group consisting of citrate, tartrate, glucoheptonate and gluconate.

14. A method according to claim 1, wherein the phosphatization solution comprises at least 2 g/l of sodium hexametaphosphate, zinc gluconate, at least 2 g/l of manganese ion introduced under the form of salt or under the form of gluconate, and nitric acid in an amount sufficient to bring the pH to an initial value lower than 2.

* * * * *